US008779982B2

(12) United States Patent
Waku et al.

(10) Patent No.: US 8,779,982 B2
(45) Date of Patent: Jul. 15, 2014

(54) SYSTEM FOR REDUCING ANTENNA GAIN DETERIORATION

(75) Inventors: Kenji Waku, Kanagawa (JP); Kunihiko Watanabe, Kanagawa (JP); Shin Takahashi, Kanagawa (JP); Tadashi Koyama, Kanagawa (JP)

(73) Assignee: KYOCERA Corporation, Kyoto (JP)

( * ) Notice: Subject to any disclaimer, the term of this patent is extended or adjusted under 35 U.S.C. 154(b) by 799 days.

(21) Appl. No.: 12/593,885

(22) PCT Filed: Mar. 28, 2008

(86) PCT No.: PCT/JP2008/056200

§ 371 (c)(1),
(2), (4) Date: Jan. 8, 2010

(87) PCT Pub. No.: WO2008/120756

PCT Pub. Date: Oct. 9, 2008

(65) Prior Publication Data

US 2011/0183730 A1 Jul. 28, 2011

(30) Foreign Application Priority Data

Mar. 29, 2007 (JP) ..... 2007-087494

(51) Int. Cl.
*H01Q 1/38* (2006.01)

(52) U.S. Cl.
USPC ..... 343/700 MS; 343/715; 343/750

(58) Field of Classification Search
CPC ..... H01Q 1/243; H01Q 21/30; H01Q 7/00
USPC ..... 343/715, 750, 700 MS
See application file for complete search history.

(56) References Cited

U.S. PATENT DOCUMENTS 6,023,611 A * 2/2000 Bolin et al. ..... 455/114.1
6,958,730 B2 10/2005 Nagumo et al.
7,408,515 B2 * 8/2008 Leisten ..... 343/702
7,705,692 B2 * 4/2010 Fukamachi et al. ..... 333/109

(Continued)

FOREIGN PATENT DOCUMENTS

JP 2001-352387 A 12/2001
JP 2004-227046 8/2004

(Continued)

OTHER PUBLICATIONS

Office Action dated Nov. 7, 2011, issued for a related U.S. Appl. No. 12/443,456.

(Continued)

*Primary Examiner* — Jacob Y Choi
*Assistant Examiner* — Jae Kim
(74) *Attorney, Agent, or Firm* — Procopio, Cory, Hargreaves & Savitch LLP

(57) ABSTRACT

A portable wireless device which effectively uses a space in a case while maintaining communication qualities by reducing antenna gain deterioration even when a plurality of antennas of different frequency bands are arranged adjacent to each other. The portable wireless device is provided with patterns for adding a band disturbing element, which is composed of beads and a parallel resonance circuit, to a part where one side of an antenna pattern of a magnetic field antenna is closed to between the main antenna and the magnetic field antenna is more easily generated. The band disturbing element may be composed of ferrite core or the like.

7 Claims, 11 Drawing Sheets

(56) References Cited

U.S. PATENT DOCUMENTS

| | | | | |
|---|---|---|---|---|
| 7,778,621 | B2 * | 8/2010 | Tandy | 455/333 |
| 8,036,629 | B2 * | 10/2011 | Tandy | 455/333 |
| 8,174,454 | B2 * | 5/2012 | Mayer | 343/725 |
| 2004/0113281 | A1 * | 6/2004 | Brandenburg et al. | 257/778 |
| 2004/0113842 | A1 | 6/2004 | du Toit et al. | |
| 2004/0135729 | A1 | 7/2004 | Talvitie et al. | |
| 2006/0192723 | A1 * | 8/2006 | Harada et al. | 343/866 |
| 2007/0063902 | A1 * | 3/2007 | Leisten | 343/702 |
| 2007/0298730 | A1 * | 12/2007 | Tandy | 455/90.3 |
| 2012/0028582 | A1 * | 2/2012 | Tandy | 455/41.2 |

FOREIGN PATENT DOCUMENTS

| | | | |
|---|---|---|---|
| JP | 2004-297499 | | 10/2004 |
| JP | 2005-252853 | A | 9/2005 |
| JP | 2006-13777 | | 1/2006 |
| JP | 2006-279677 | | 10/2006 |
| WO | 2006/112468 | A1 | 10/2006 |

OTHER PUBLICATIONS

Notice of Reasons for Rejection dated Sep. 27, 2011, issued for counterpart Japanese Application No. 2009-507539.

* cited by examiner

SYSTEM FOR REDUCING ANTENNA GAIN DETERIORATION

CROSS REFERENCE TO RELATED APPLICATIONS

This application is the U.S. National Stage application of PCT application PCT/JP2008/056200 filed on Mar. 28, 2008, which claims priority under 35 U.S.C. §119 to Japanese Patent Application No. 2007-087494, filed Mar. 29, 2007, and the contents of each of these applications are incorporated herein by reference in their entirety.

FIELD OF THE INVENTION

The present invention relates to a portable wireless device for communicating with other terminals.

BACKGROUND

Recently, for improved functionality, portable wireless devices provided with a communicating means built into a body thereof, for communication by means of RFID (Radio Frequency Identification), which is a contactless IC (Integrated Circuit) chip, and the like, are becoming common (for example, see Patent Document 1).

In addition, as shown in Patent Document 1, although portable wireless devices are generally provided with a retractable main antenna outside a body thereof, for communicating with a mobile communication network, portable wireless devices with a main antenna built into a body thereof, for a more sophisticated design, are becoming common recently.

Patent Document 1: Japanese Unexamined Patent Application, First Publication No. 2004-227046

SUMMARY

Although the main antenna for communication and an antenna such as an RFID use different usable frequency bands, the antennas are disposed as far as possible from each other in order to suppress interference effects of the antennas with each other. This makes efficient use of space inside the body difficult.

The present invention has been made in view of the above-mentioned problems, and one objective thereof is to provide a portable wireless device that allows for effective use of space inside the body while suppressing gain degradation of a plurality of antennas having different frequency bands disposed adjacently in the body.

In order to solve the above problems, the portable wireless device according to the present invention is characterized by including: a body; a first communication unit arranged in the body and including a first antenna unit that communicates with an external device by way of a first usable frequency band, and a first information processing unit that performs predetermined processing with respect to information communicated by the first antenna unit; a second communication unit arranged in the body and including a second antenna unit that is disposed in the vicinity of the first antenna unit and communicates by way of a second usable frequency band that is a frequency band overlapping a high-order secondary resonance point of the first usable frequency band, and a second information processing unit that performs predetermined processing with respect to information communicated by the second antenna unit; and a reducing unit for reducing a frequency component in the high-order secondary resonance point of the first usable frequency band.

Moreover, in the portable wireless device, it is preferable that the first antenna unit is a magnetic field antenna, and the reducing unit is a band limiting element, which is connected to the magnetic field antenna, and which exhibits high impedance in a frequency band relating to the high-order secondary resonance point.

In addition, in the portable wireless device, it is preferable that the first antenna unit is disposed so that at least a portion thereof faces the second antenna unit in a predetermined direction, and the band limiting element is connected to a portion of the first antenna unit facing the second antenna unit.

Furthermore, in the portable wireless device, the first communication unit is a contactless IC (Integrated Circuit) chip that communicates with an external device using electromagnetic induction or electromagnetic coupling.

Moreover, in order to solve the above problems, the portable wireless device according to the present invention is characterized by including: a body; a first communication unit arranged in the body and including a first antenna unit that communicates with an external device by way of a first usable frequency band, and a first information processing unit that performs predetermined processing with respect to information communicated by the first antenna unit; a second communication unit arranged in the body and including a second antenna unit that communicates by way of a second usable frequency band that is a frequency band overlapping a high-order secondary resonance point of the first usable frequency band and generated by resonance of the first usable frequency band, the second antenna unit being disposed at a position to an extent that interference with the first antenna unit would arise, and a second information processing unit that performs predetermined processing with respect to information communicated by the second antenna unit; and a reducing unit for reducing a frequency component in the secondary resonance point of the first usable frequency band, which is generated by resonance of the first usable frequency band.

In addition, in the portable wireless device, it is preferable that the first communication unit is arranged in the body and includes a third antenna unit that communicates with an external device by way of a third usable frequency band, and a third information processing unit that performs predetermined processing with respect to information communicated by the third antenna unit, and it is preferable that the reducing unit is connected to a portion of the first antenna unit and a portion of the third antenna unit, and reduces a frequency component in the high-order secondary resonance point of the first usable frequency band and a frequency component in a high-order secondary resonance point of the third usable frequency band.

According to the present invention, even if a plurality of antennas having different frequency bands are disposed adjacently in the body, influences due to interference between antenna gains are suppressed; therefore, it is possible to effectively utilize the space inside the body while maintaining the communication quality.

DETAILED DESCRIPTION

A description is provided hereinafter regarding an embodiment of the present invention.

Figure 1:
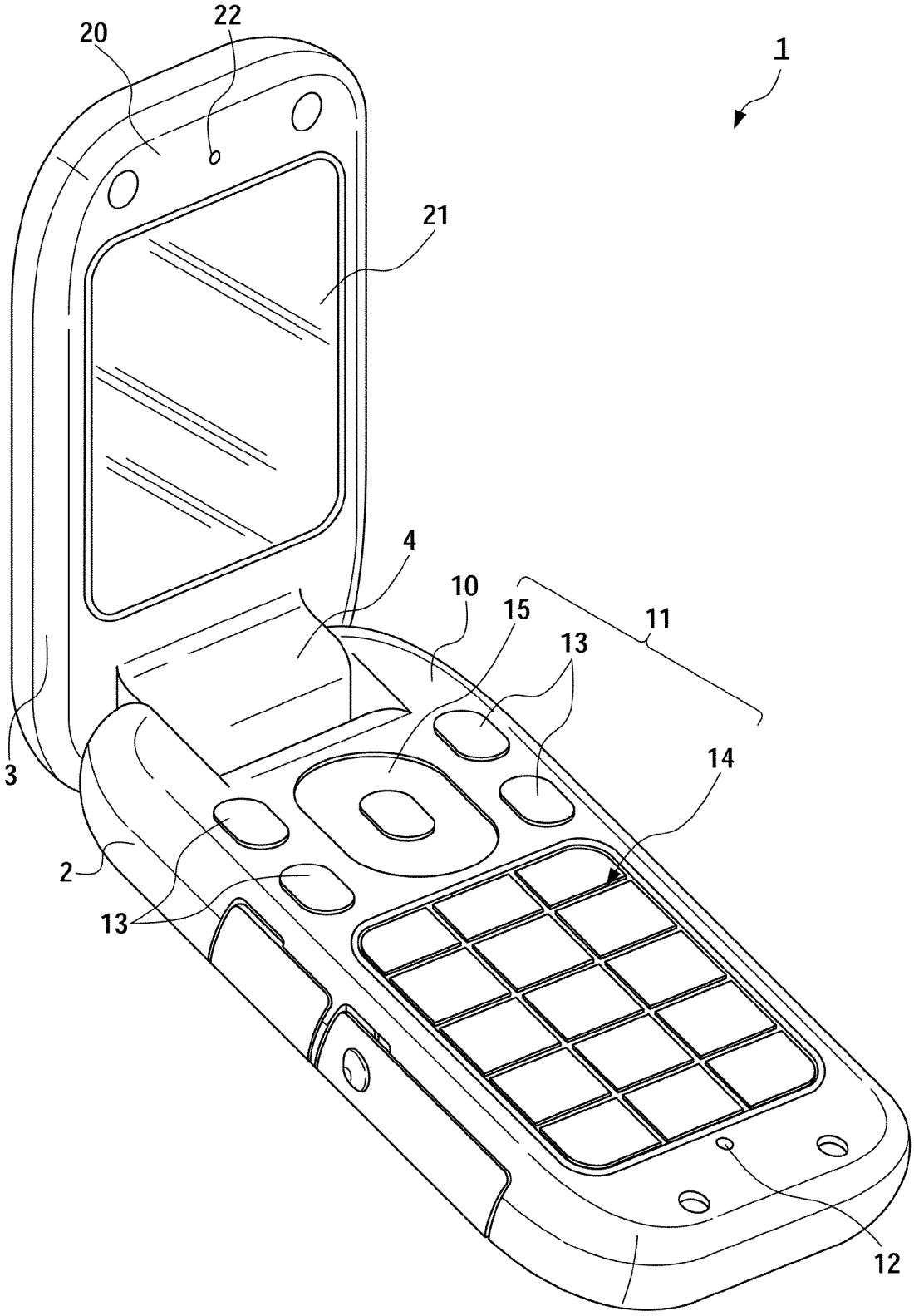
FIG. 1 is a perspective view showing an appearance of a cellular telephone device according to the present invention.

FIG. 1 is a perspective view showing an appearance of a cellular telephone device 1 as an example of the portable wireless device according to the present invention. It should be noted that, although FIG. 1 shows a so-called folder-type cellular telephone device, the present invention is not limited thereto.

The cellular telephone device 1 is configured to include an operation unit side body 2 and a display unit side body 3. The operation unit side body 2 is configured to include, on a front face 10 thereof, an operation button set 11 and a sound input unit 12 to which sounds, which a user of the cellular telephone device 1 produces during a phone call, are input. The operation button set 11 includes: feature setting operation buttons 13 for operating various settings and various features such as a telephone number directory feature and a mail feature; input operation buttons 14 for inputting digits of a telephone number and characters for mail; and a selection operation button 15 that performs selection of the various operations and scrolling.

The display unit side body 3 is configured to include, on a front face portion 20, a display 21 for displaying various information, and a sound output unit 22 for outputting sound of the other party of a conversation.

In addition, the abovementioned operation button set 11, the sound input unit 12, the display 21, and the sound output unit 22 compose a processing unit 62 to be described later.

Furthermore, an upper end portion of the operation unit side body 2 and a lower end portion of the display unit side body 3 are connected via a hinge mechanism 4. Moreover, the cellular telephone device 1 can be made into a state in which the operation unit side body 2 and the display unit side body 3 are opening each other (opened state), and into a state in which the operation unit side body 2 and the display unit side body 3 are closing each other (closed state), as the operation unit side body 2 and the display unit side body 3, connected via the hinge mechanism 4, pivot with respect to each other.

Figure 2:
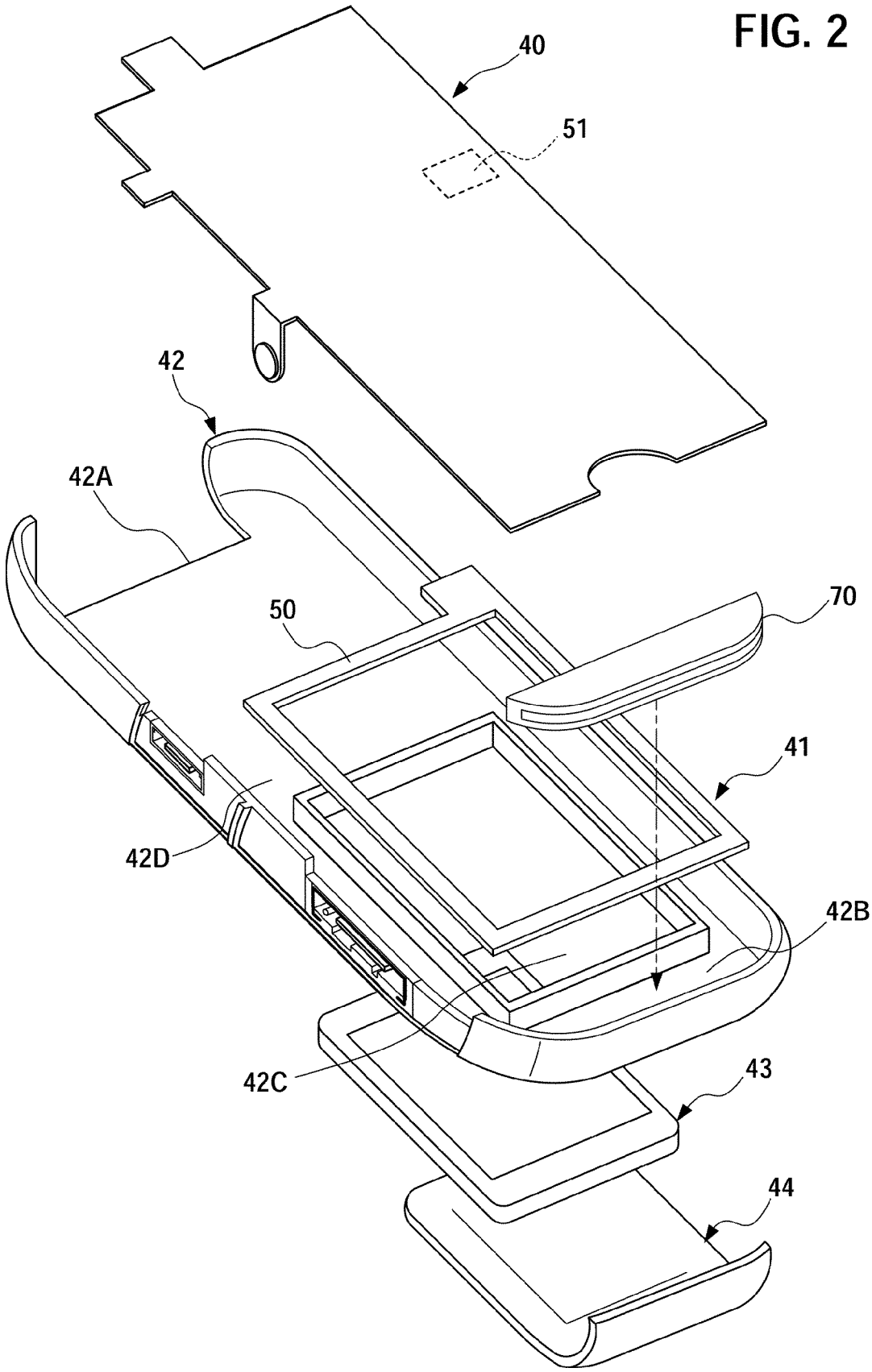
FIG. 2 is a perspective view showing a configuration of an operation unit side body included in the cellular telephone device according to the present invention.

FIG. 2 is an exploded perspective view of a part of the operation unit side body 2. The operation unit side body 2 is composed of a substrate 40, an RFID portion 41, a rear case portion 42, a rechargeable battery 43, and a battery cover 44, as shown in FIG. 2.

On the substrate 40, a device such as a CPU for performing predetermined arithmetic processing is mounted, and a predetermined signal is transmitted thereto when a user operates the operation button set 11.

The RFID portion 41 includes a magnetic field antenna 50 (a first antenna unit) for communicating with external devices by way of a first usable frequency band, and an RFID chip 51 (a first information processing unit) that performs predetermined processing with respect to information communicated by the magnetic field antenna 50. It should be noted that the RFID chip 51 is disposed on the substrate 40 facing the RFID portion 41 as shown in FIG. 2. Moreover, the RFID portion 41 is later described in detail.

The rear case portion 42 includes: a hinge mechanism fixing portion 42A for fixing the hinge mechanism 4; a main antenna housing portion 42B for housing a main antenna 70 (a second antenna unit), which communicates using a second usable frequency band that is higher than the first usable frequency band; a battery housing portion 42C for housing the rechargeable battery 43; and an RFID portion fixing portion 42D for fixing the RFID portion 41. It should be noted that the main antenna 70 is described later in detail.

Figure 3:
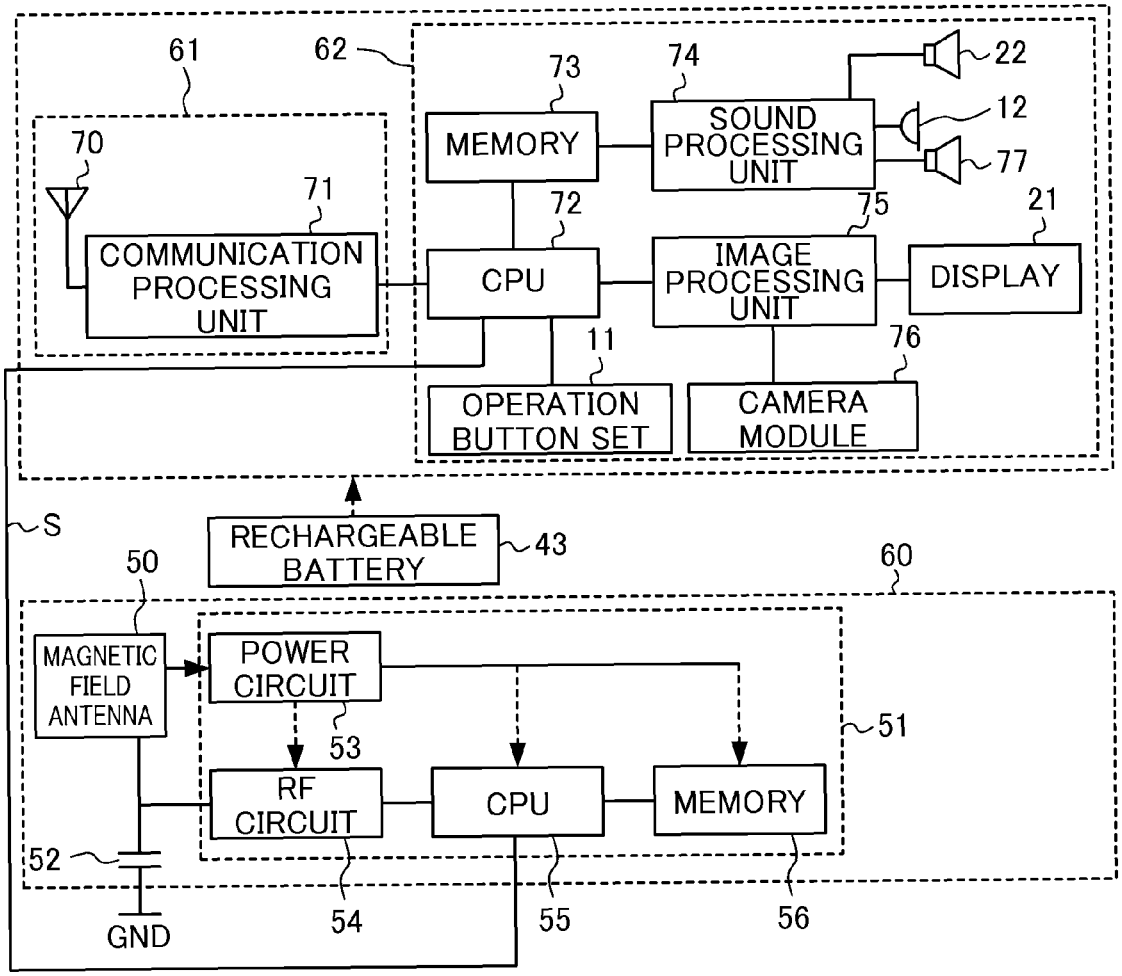
FIG. 3 is a block diagram showing features of the cellular telephone device according to the present invention.

FIG. 3 is a functional block diagram showing features of the cellular telephone device 1. As shown in FIG. 3, the cellular telephone device 1 includes: a first communication unit 60 that is configured with the RFID portion 41; a second communication unit 61 that communicates with external terminals; and a processing unit 62 that processes information communicated by the second communication unit 61.

The first communication unit 60 is composed of the RFID portion 41 and includes the magnetic field antenna 50 that communicates with external devices by way of the first usable frequency band (for example, 13.56 MHz), the RFID chip 51, and a capacitor 52 for adjustment.

The magnetic field antenna 50 includes a coil wound in a multiple spiral shape on a sheet made of PET (polyethylene terephthalate) material, and receives a signal of the first usable frequency band transmitted from external devices.

The RFID chip 51 includes: a power circuit 53 that generates a predetermined voltage based on electrical power induced by a signal received by the magnetic field antenna 50; an RF circuit 54 that performs signal processing such as modulation processing or demodulation processing with respect to a signal communicated by the magnetic field antenna 50; a CPU 55 that performs predetermined arithmetic processing; and memory 56 that stores predetermined data. The power circuit 53 is composed of a DC-DC converter, for example.

Here, behavior of the first communication unit 60 is described.

The magnetic field antenna 50, when approaching to within a predetermined distance to a reading/writing device disposed outside thereof, receives radio waves transmitted from the reading/writing device (modulated by a carrier frequency having the first usable frequency band (for example, 13.56 MHz)). It should be noted that, a predetermined adjustment (tuning) is made to the capacitor 52 so that the radio waves of the first usable frequency band are transmitted to the RF circuit 54 via the magnetic field antenna 50.

In addition, electromotive force is generated by an electromagnetic induction effect when the electromagnetic waves are received by the magnetic field antenna 50.

The power circuit 53 generates a predetermined power supply voltage from the electromotive force generated by the electromagnetic induction effect, and supplies the power supply voltage to the RF circuit 54, the CPU 55, and the memory 56. In addition, the RF circuit 54, the CPU 55, and the memory 56 are switched from a halt state to an active state when the predetermined power supply voltage is supplied from the power circuit 53.

The RF circuit 54 performs signal processing such as demodulation with respect to a signal of the first usable frequency band received via the magnetic field antenna 50, and transmits the processed signal to the CPU 55.

The CPU 55 writes or reads data to or from the memory 56, based on the signal received from the RF circuit 54. In a case of reading data from the memory 56, the CPU 55 transmits the data to the RF circuit 54. The RF circuit 54 performs signal processing such as modulation with respect to the data being read from the memory 56, and transmits the data to the external reading/writing device via the magnetic field antenna 50.

Furthermore, although the first communication unit 60 is described above to be of a so-called passive, induction field type (electromagnetic induction type) without a power source, the present invention is not limited thereto, and the first communication unit 60 can also be of a passive mutual induction type (electromagnetic coupling type) or a passive radiation field type (radio wave type), or an active type with a power source. In addition, an access method of the first communication unit 60 is described as a reading/writing type; however, the present invention is not limited thereto, and the access method can also be of a read-only type, a write-once type, and the like.

Moreover, as shown in FIG. 3, the second communication unit 61 includes: a main antenna 70 that communicates with external devices by way of the second usable frequency band that is higher than the first usable frequency band; and a communication processing unit 71 (a second information processing unit) that performs signal processing such as modulation processing or demodulation processing. In addition, the second communication unit 61 is powered by the rechargeable battery 43.

The main antenna 70 communicates with external devices by way of the second usable frequency band (for example, 800 MHz). It should be noted that, although 800 MHz is set as the second usable frequency band in the present embodiment, other frequency bands can also be used. In addition, the main antenna 70 can be configured as a so-called dual band compatible antenna that can accept, in addition to the second usable frequency band, a third usable frequency band (for example, 2 GHz), or as a multi-band compatible antenna that can further accept a fourth usable frequency band.

The communication processing unit 71 performs demodulation processing of a signal received by the main antenna 70 to transmit the processed signal to the processing unit 62, or performs modulation processing of a signal received from the processing unit 62 to transmit the processed signal to an external device via the main antenna 70.

As shown in FIG. 3, the processing unit 62 includes: the operation button set 11; the sound input unit 12; the display 21; the sound output unit 22; a CPU 72 that performs predetermined arithmetic processing; memory 73 that stores predetermined data; a sound processing unit 74 that performs predetermined sound processing; an image processing unit 75 that performs predetermined image processing; a camera module 76 that captures an image of an object; and a speaker 77 that outputs ringtones and the like. In addition, the processing unit 62 is powered by the rechargeable battery 43. It should be noted that, as shown in FIG. 3, the cellular telephone device 1 is configured such that: the CPU 55 and the CPU 72 are connected by a signal line S via which information processed by the first communication unit 60 is transmitted to the image processing unit 75; and information processed by the image processing unit 75 is displayed on the display 21.

Figure 4:
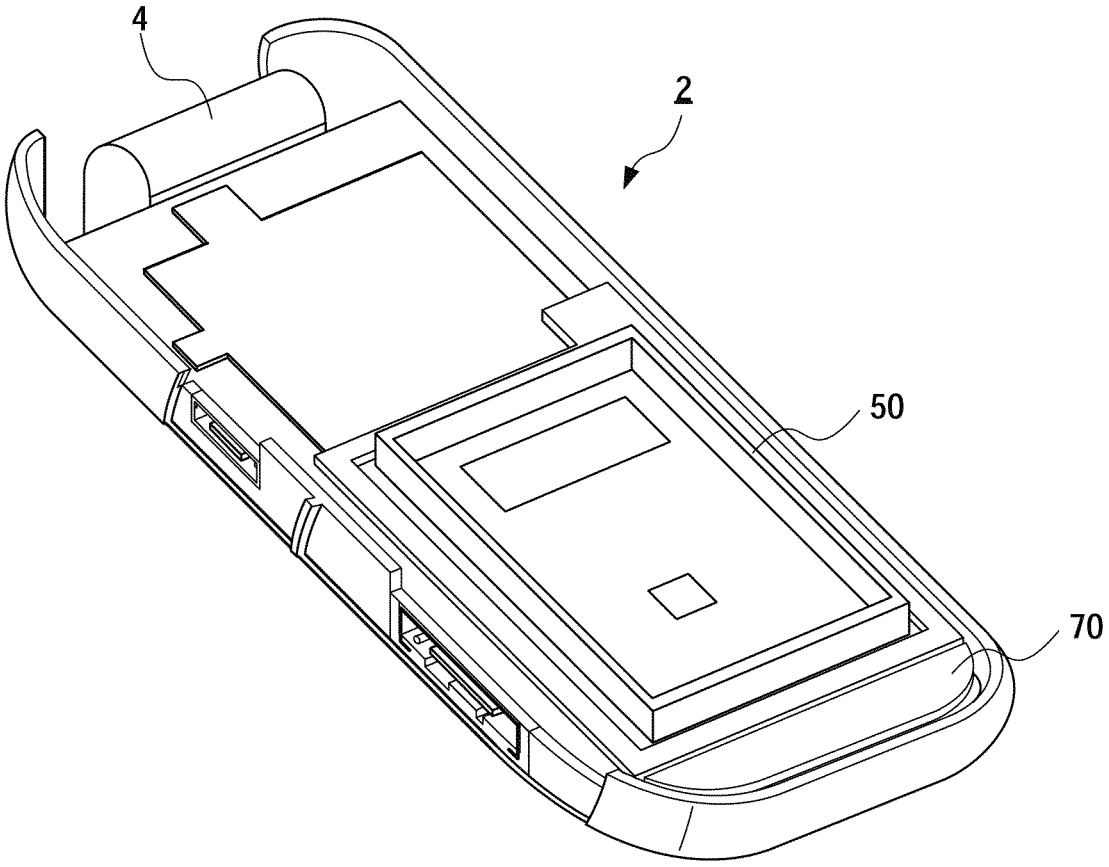
FIG. 4 is a perspective view showing a positional relationship between a magnetic field antenna and a main antenna provided in the cellular telephone device according to the present invention.

In addition, FIG. 4 is a diagram showing a positional relationship between the magnetic field antenna 50 of the RFID portion 41 and the main antenna 70. It should be noted that the rear case portion 42 is omitted in FIG. 4.

As shown in FIG. 4, the magnetic field antenna 50 and the main antenna 70 are in the vicinity of each other (several millimeters). In a case in which the two antennas are disposed in the vicinity of each other in this manner, problems occur due to interference between the magnetic field antenna 50 and the main antenna 70.

More specifically, the magnetic field antenna 50 has low-order and high-order secondary resonance points in cycles, other than the usable frequency band (13.56 MHz). In particular, when the high-order secondary resonance point (hereinafter referred to as high-order resonance point) overlaps the usable frequency band (800 MHz or the like) of the main antenna 70, the gain of the main antenna 70 is degraded (to be described later in detail with reference to FIG. 9).

Given this, the cellular telephone device 1 according to the present embodiment adopts a configuration that reduces a frequency component in the high-order resonance point of the magnetic field antenna 50, in order to prevent interference with the main antenna 70 by a high-order resonance point of the magnetic field antenna 50, thereby avoiding the gain degradation of the main antenna 70.

Figure 5:
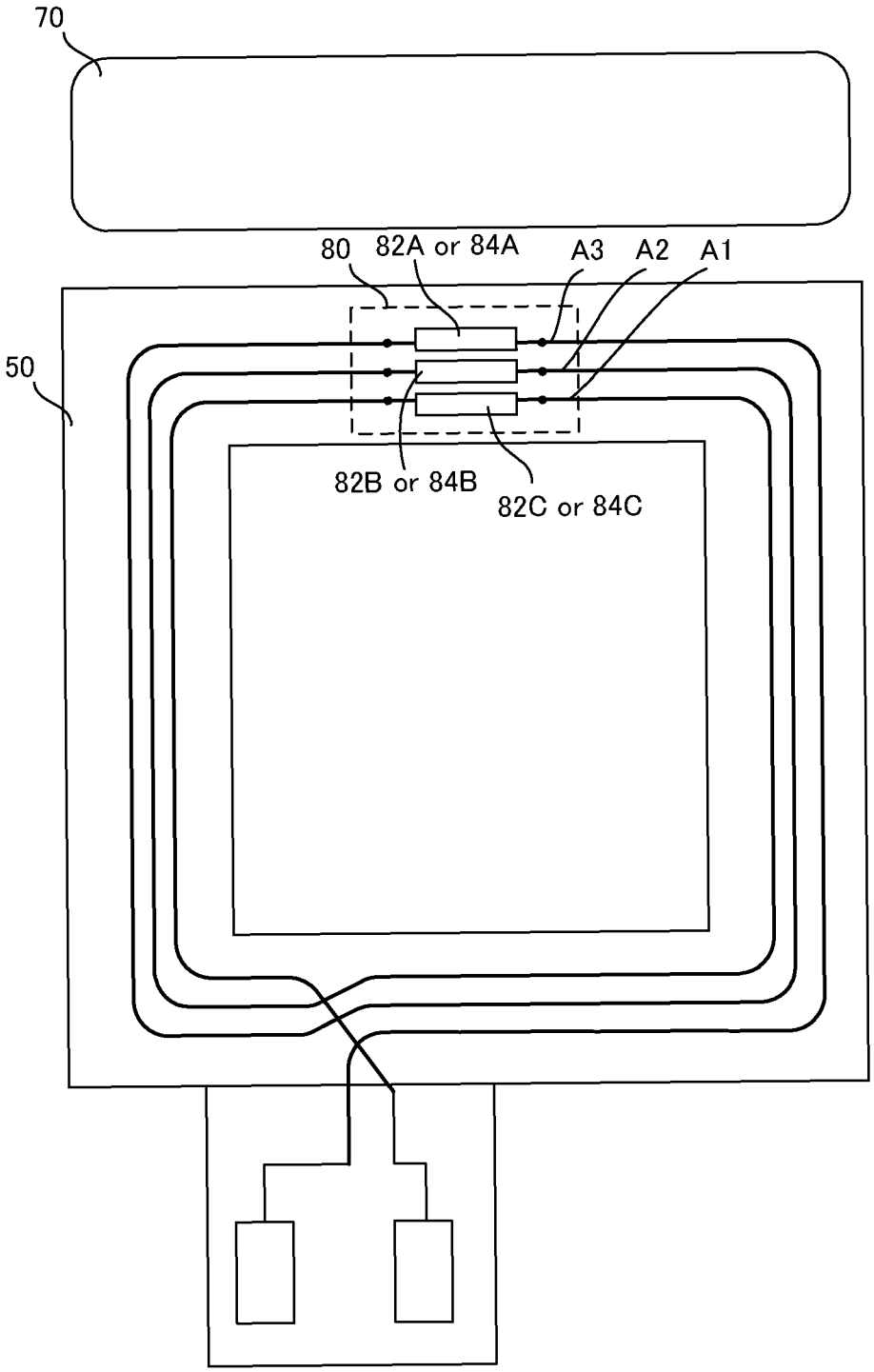
FIG. 5 is a diagram showing a first configuration of the magnetic field antenna provided in the cellular telephone device according to the present invention.

More specifically, as shown in FIG. 5, in order to adjust the frequency characteristic of the main antenna 70, the cellular telephone device 1 is provided with patterns (A1, A2 and A3) for adding a band limiting element 80 (reducing unit), which is composed of beads (82A, 82B, 82C) or a parallel resonance circuit (84A, 84B, 84C), to a portion in which one side of the antenna patterns of the magnetic field antenna 50 is the closest to the main antenna 70, i.e. a portion in which interference between the main antenna 70 and the magnetic field antenna 50 is most likely generated. It should be noted that the patterns (A1, A2 and A3) each denote a terminal for adding the band limiting element 80. Moreover, although the band limiting element 80 is described as being added to each line configuring the magnetic field antenna 50 in FIG. 5, it is not limited thereto, and it may be added, for example, only to the line (A3 in FIG. 5) that is in the closest to the main antenna 70.

Moreover, the band limiting element 80, in which the high-order resonance point of magnetic field antenna 50 has been adjusted to a constant that can be reduced, is added to the patterns (A1, A2 and A3).

Figure 6:
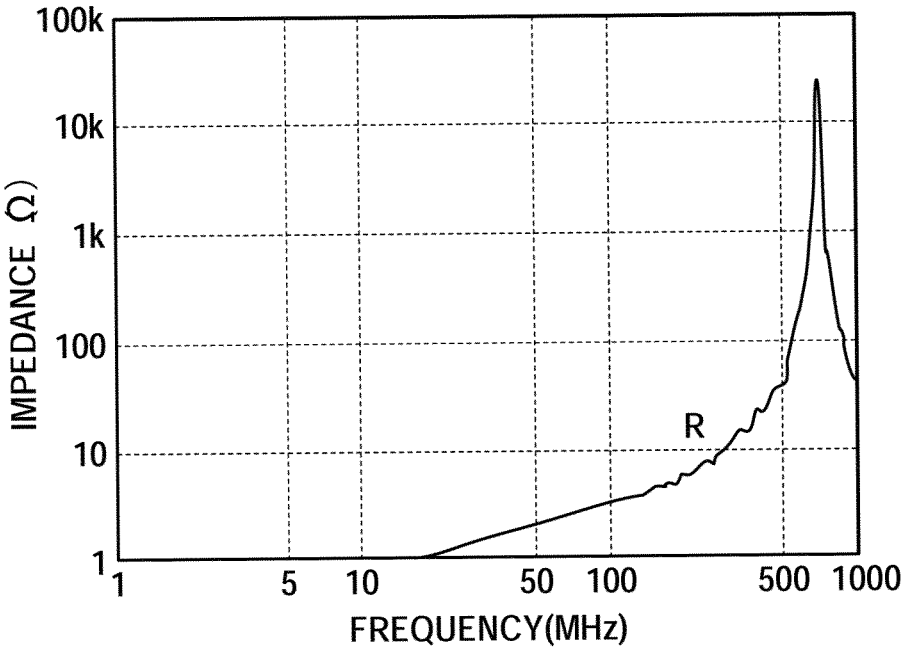
FIG. 6 is a graph showing characteristics of a band limiting element.

Here, features of the band limiting element 80 are described. As shown in FIG. 6, the band limiting element 80 has a characteristic in which impedance is high (R component is high) in the high frequency band (around 800 MHz), and has a characteristic in which impedance is low (R component is low) in the low frequency band (around 13 MHz) (has a characteristic in which the high-order resonance point of the magnetic field antenna 50 exhibits the highest impedance value, particularly in this case). In other words, the band limiting element 80 has a characteristic to convert a high frequency signal into heat and absorb it in the high frequency band.

Therefore, by providing the band limiting element 80 in the portion in which the magnetic field antenna 50 is in the vicinity of the main antenna 70, the frequency component in the high-order resonance point of the magnetic field antenna 50 is reduced, thereby reducing the influence due to the high-order resonance point of the magnetic field antenna 50 in the usable frequency band (high frequency band) of the main antenna 70. Moreover, since the band limiting element 80 is added to one side (A3 in FIG. 5) that is the closest to the main antenna 70 among the antenna patterns of the magnetic field antenna 50, it is possible to efficiently reduce the frequency component in the high-order resonance point of the magnetic field antenna 50.

Figure 7:
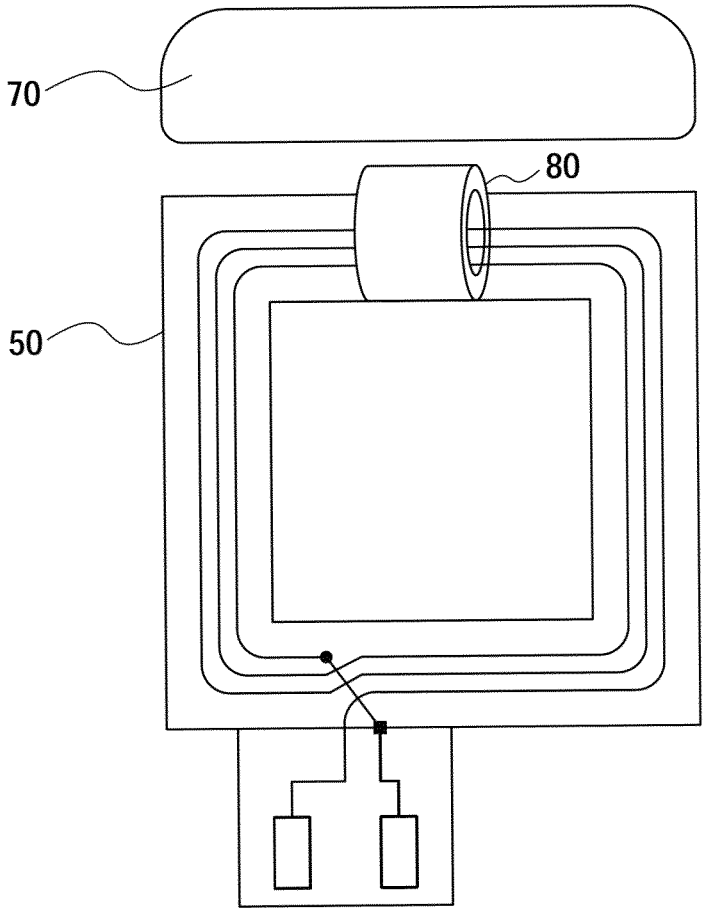
FIG. 7 is a diagram showing a second configuration of the magnetic field antenna provided in the cellular telephone device according to the present invention.

In addition, the band limiting element 80 may be configured with a ferrite core as shown in FIG. 7.

Furthermore, the RFID portion 41 adjusts a resonance (tuning) frequency to 13.56 MHz based on a reactance value (L) of the magnetic field antenna 50 and the reactance value (C) of the capacitor 52. Here, the value L is determined by a size of the magnetic field antenna 50, the number of turns of the coil, the presence of material (a dielectric material or a magnetic material) provided therearound, or a distance from metal disposed in the vicinity thereof. Moreover, the value L of the magnetic field antenna 50 is dominant with respect to the high-order resonance point. However, according to the present embodiment, since the high-order resonance point can be reduced by adding the band limiting element 80 to a portion of the magnetic field antenna 50, the magnetic field antenna 50 can be freely designed regardless of a size thereof, the number of turns of the coil, the presence of material provided therearound, or a distance from metal disposed in the vicinity thereof.

In addition, since the stray capacitance of the band limiting element 80 is small (on the order of several pF), the usable frequency of the magnetic field antenna 50 is not affected.

In this way, in the cellular telephone device 1, since the high-order resonance point of the magnetic field antenna 50 is reduced by adding the band limiting element 80 to a portion in which one side of the antenna patterns of the magnetic field antenna 50 is the closest to the main antenna 70, the influence on the main antenna 70 due to the high-order resonance point of the magnetic field antenna 50 in the usable frequency band (800 MHz) can be reduced without affecting the usable frequency band (13.56 MHz) of the magnetic field antenna 50.

Figure 8:
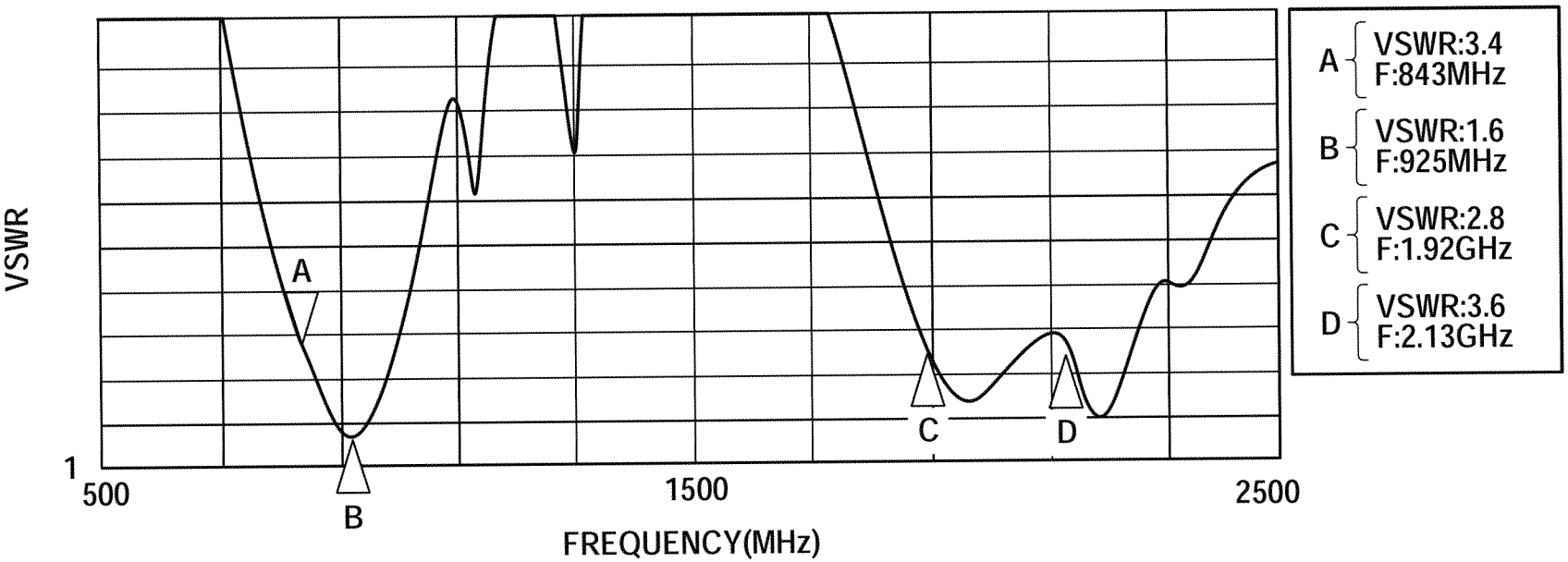
FIG. 8 is a graph showing a result of measuring VSWR in a case in which the band limiting element is added to the magnetic field antenna.
Figure 9:
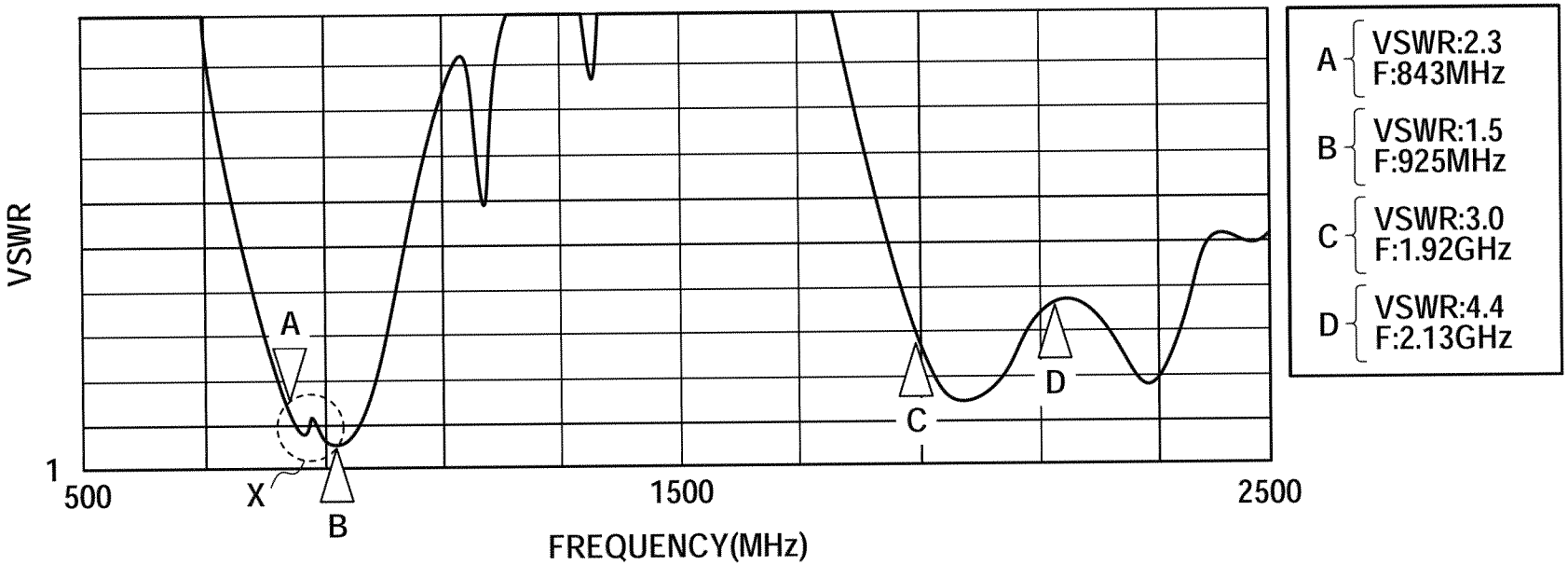
FIG. 9 is a graph showing a result of measuring VSWR in a case in which the band limiting element is not added to the magnetic field antenna.

Moreover, FIG. 8 shows a result of measuring VSWR (Voltage Standing Wave Ratio) in a frequency range of 500 MHz to 2.5 GHz in a case in which the band limiting element 80 is added to a portion in which one side of the antenna patterns of the magnetic field antenna 50 is the closest to the main antenna 70 (in the cellular telephone device 1 according to the present embodiment); and FIG. 9 shows a result of measuring VSWR in a frequency range of 500 MHz to 2.5 GHz in a case in which the band limiting element 80 is not added to the magnetic field antenna 50 (in a conventional cellular telephone device). It should be noted that the measurement was performed by connecting a measurement apparatus (network analyzer) to a feeding point of the main antenna 70 of the cellular telephone device 1. Moreover, the measurement was performed by using a cellular telephone device with a band width of a usable frequency band of 843 MHz to 925 MHz (point A to point B in FIG. 8 and FIG. 9) and that of 1.92 GHz to 2.18 GHz (point C to point D in FIG. 8 and FIG. 9).

As can be seen from FIGS. 8 and 9, the influence of the high-order resonance point of the magnetic field antenna 50 appeared (X in FIG. 9) in a range of 843 MHz to 925 MHz (point A to point B in FIG. 9) in a case in which the band limiting element 80 was not added to the magnetic field antenna 50 (FIG. 9), while the influence of the high-order resonance point of the magnetic field antenna 50 disappeared in the range of 843 MHz to 925 MHz (point A to point B in FIG. 8) in a case in which the band limiting element 80 was added to the magnetic field antenna 50 (FIG. 8).

Therefore, according to the present embodiment, by adding the band limiting element 80 to a portion in which one side of the antenna patterns of the magnetic field antenna 50 is the closest to the main antenna 70, the high-order resonance point of the magnetic field antenna 50 can be reduced (or disappeared), thereby making it possible to prevent influence on the usable frequency band of the main antenna 70, and to avoid gain degradation of the main antenna 70. Moreover, according to the present embodiment, the gain degradation of the main antenna 70 is reduced even if the magnetic field antenna 50 and the main antenna 70 are disposed to be adjacent; therefore, it is possible to effectively utilize the space inside the body and to achieve a size reduction of the body itself, while maintaining the communication quality and placing emphasis on design characteristics. Furthermore, in the present embodiment, since the band limiting element 80, which is integrated into the magnetic field antenna 50, is used as a wiring pattern of the magnetic field antenna 50 as a means for reducing the high-order resonance point of the magnetic field antenna 50, a separate member as the reducing unit is not required to be provided inside the body, thereby making it possible to effectively utilize the space inside the body and to achieve a size reduction of the body itself.

It should be noted that, in the aforementioned embodiment, although a case is assumed in which interference would arise since the main antenna 70 and the magnetic field antenna 50 are disposed to be adjacent, the present invention is effective for any case in which the influence due to the high-order resonance point of the magnetic field antenna 50 affects a usable frequency band of other antennas, regardless of a positional relationship between the antennas.

In addition, in the aforementioned embodiment, although the RFID is shown as a component for communicating with external devices by the first usable frequency band, it is not particularly limited thereto, and another component may be used as long as the component would cause interference with the usable frequency band of the main antenna 70.

Moreover, in order to provide two functions of a card function and a reading/writing function to a portable wireless device, a configuration is conceivable in which two antennas (a passive-type magnetic field antenna and an active-type magnetic field antenna) are arranged in the body; and even in such a configuration in which a plurality of antennas are arranged together with the main antenna 70 in the body, by integrally connecting the band limiting element 80 to each of the plurality of antennas, the frequency component in the high-order resonance point of each of the plurality of antennas can be preferably reduced, thereby making it possible to reduce the influence on the usable frequency band (high frequency band) of the main antenna 70 due to the high-order resonance point of each of the plurality of antennas. Here, the card function refers to a function to detect a passive-type magnetic field antenna from an external device side having a reading/writing function, thereby transmitting and receiving data; and the reading/writing function refers to a function to spontaneously detect an external device from an active-type magnetic field antenna side, thereby transmitting and receiving data.

Figure 10:
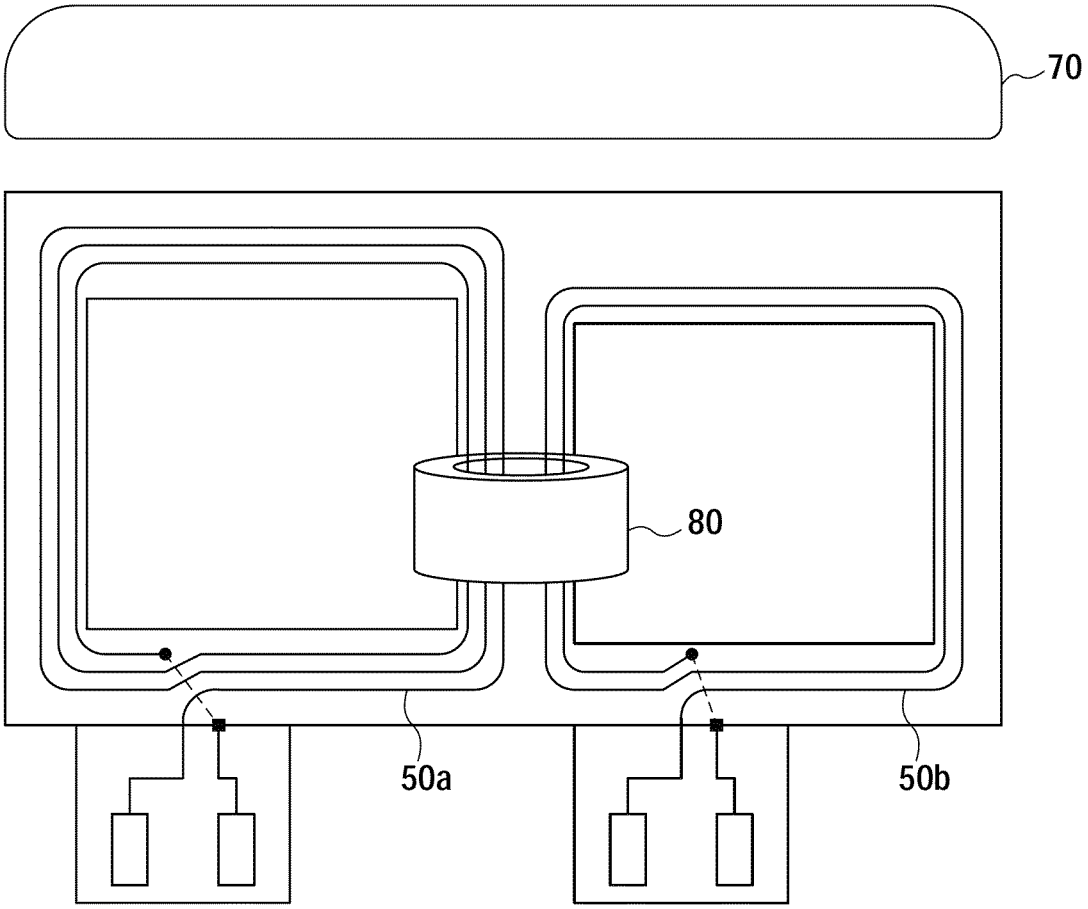
FIG. 10 is a diagram showing a third configuration of the magnetic field antenna provided in the cellular telephone device according to the present invention.
Figure 11:
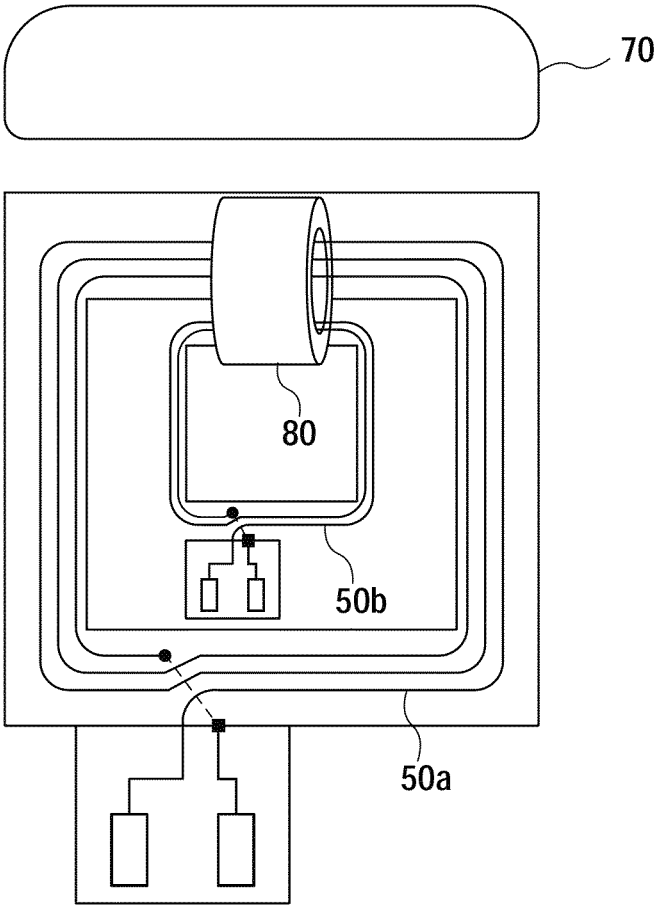
FIG. 11 is a diagram showing a fourth configuration of the magnetic field antenna provided in the cellular telephone device according to the present invention.

FIG. 10 is a diagram showing an example of this configuration, and shows a configuration in which a passive-type magnetic field antenna 50*a* and a active-type magnetic field antenna 50*b* are arranged together with the main antenna in the body, and are each connected to a single band limiting element 80 (ferrite core). Moreover, FIG. 11 is a diagram showing an example of this configuration, and shows a configuration in which the passive-type magnetic field antenna 50*a* and the active-type magnetic field antenna 50*b* that is in an inner region thereof are arranged together with the main antenna 70 in the body, and are each connected to the single band limiting element 80 (ferrite core).

In such a case in which the passive-type magnetic field antenna 50*a* and the active-type magnetic field antenna 50*b* are arranged in the vicinity of the main antenna 70 in the body, each high-order resonance point of the passive-type magnetic field antenna 50*a* and the active-type magnetic field antenna 50*b* may interfere with the usable frequency band of the main antenna 70; however, by connecting the single band limiting element 80 to both a portion of the passive-type magnetic field antenna 50*a* and a portion of the active-type magnetic field antenna 50*b*, the frequency component in the high-order resonance point of each of the passive-type magnetic field antenna 50*a* and the active-type magnetic field antenna 50*b* can be preferably reduced, thereby making it possible to reduce the influence on the usable frequency band (high frequency band) of the main antenna 70 due to the high-order resonance point of each of the plurality of antennas.

In addition, the band limiting element 80, which is integrally connected to a portion of the magnetic field antenna 50*a* and a portion of the magnetic field antenna 50*b*, makes it possible to reduce the frequency component in the high-order resonance point of each of the plurality of antennas in a collective manner; therefore, it is not required to separately provide a means for reducing the frequency component in the high-order resonance point for each of the plurality of antennas, thereby achieving greater efficiency of the space inside the body, reduction of the number of parts, and a size reduction of the body as a whole. It should be noted that the plurality of antennas are not limited to the two magnetic field antennas, and may be configured with more than two antennas of another kind.

The invention claimed is:

1. A portable wireless device comprising:

a body;

a first antenna unit that communicates with an external device by way of a first frequency band, wherein the first antenna unit comprises a spiral antenna pattern comprising a line configured in a spiral shape;

a second antenna unit that is disposed in the vicinity of the first antenna unit and communicates by way of a second frequency band that overlaps a high-order secondary resonance point of the first frequency band; and a reducing unit for reducing a frequency component in the high-order secondary resonance point of the first frequency band, wherein the reducing unit comprises a band-limiting element provided in the middle of the line, wherein the band-limiting element comprises a parallel resonance circuit, wherein the band-limiting element has high impedance in the second frequency band and low impedance in the first frequency band, and wherein the band-limiting element is provided on a side of the spiral antenna pattern that is closest to the second antenna.

2. The portable wireless device according to claim 1, wherein the first antenna unit is a magnetic field antenna, and wherein the line of the spiral antenna pattern comprises a coil wound in a spiral shape.

3. The portable wireless device according to claim 1, further comprising a first communication unit which comprises the first antenna unit, wherein the first communication unit comprises a contactless IC (Integrated Circuit) chip that communicates with an external device using electromagnetic induction or electromagnetic coupling.

4. The portable wireless device according to claim 1, wherein the reducing unit comprises band-limiting elements that are provided to multiple portions of the line of the spiral antenna pattern, and wherein the band-limiting elements are all provided to the side of the spiral antenna pattern that is closest to the second antenna unit.

5. The portable wireless device according to claim 1, further comprising a first communication unit arranged in the body, wherein the first communication unit comprises the first antenna unit and a first information processing unit that performs predetermined processing with respect to information communicated by the first antenna unit.

6. The portable wireless device according to claim 5, further comprising a second communication unit arranged in the body, wherein the second communication unit comprises the second antenna unit and a second information processing unit that performs predetermined processing with respect to information communicated by the second antenna unit.

7. The portable wireless device according to claim 1, wherein the second antenna unit is configured to communicate by way of both the second frequency band and one or more different frequency bands.

* * * * *